US008624212B2

(12) United States Patent
Yang et al.

(10) Patent No.: US 8,624,212 B2
(45) Date of Patent: Jan. 7, 2014

(54) RADIATION RESISTANT CLOTHING

(71) Applicants: Hong Fu Jin Precision Industry (ShenZhen) Co, Ltd., Shenzhen (CN); Hon Hai Precision Industry Co., Ltd., New Taipei (TW)

(72) Inventors: Yong-Sheng Yang, Shenzhen (CN); Xiao-Lian He, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/914,605

(22) Filed: Jun. 10, 2013

(65) Prior Publication Data

US 2013/0327965 A1 Dec. 12, 2013

(30) Foreign Application Priority Data

Jun. 11, 2012 (CN) ..... 2012 1 01898569

(51) Int. Cl.
*G21F 3/02* (2006.01)
*G21F 1/00* (2006.01)

(52) U.S. Cl.
USPC ..... 250/516.1; 250/505.1; 250/515.1

(58) Field of Classification Search
USPC ..... 250/505.1, 515.1, 516.1
See application file for complete search history.

(56) References Cited

U.S. PATENT DOCUMENTS

| | | | | |
|---|---|---|---|---|
| 4,604,998 | A * | 8/1986 | Bellina | 128/849 |
| 4,980,564 | A * | 12/1990 | Steelmon | 250/505.1 |
| 5,038,047 | A * | 8/1991 | Still | 250/516.1 |
| 5,245,195 | A * | 9/1993 | Shah et al. | 250/515.1 |
| 6,281,515 | B1 * | 8/2001 | Demeo et al. | 250/516.1 |
| 6,459,091 | B1 * | 10/2002 | DeMeo et al. | 250/516.1 |
| 6,749,859 | B2 * | 6/2004 | Leibowitz | 424/402 |
| 6,828,578 | B2 * | 12/2004 | DeMeo et al. | 250/519.1 |
| 6,991,849 | B2 * | 1/2006 | Oya | 428/353 |
| 7,476,889 | B2 * | 1/2009 | DeMeo et al. | 250/516.1 |
| 8,067,758 | B2 * | 11/2011 | Popa-Simil et al. | 250/515.1 |
| 8,334,524 | B2 * | 12/2012 | DeMeo et al. | 250/516.1 |
| 2005/0211930 | A1 * | 9/2005 | DeMeo et al. | 250/516.1 |
| 2009/0114857 | A1 * | 5/2009 | DeMeo et al. | 250/516.1 |
| 2009/0236569 | A1 * | 9/2009 | Pike-Biegunski et al. | 252/519.3 |
| 2013/0230719 | A1 * | 9/2013 | Pike-Biegunski et al. | 428/402 |

* cited by examiner

*Primary Examiner* — David A Vanore
(74) *Attorney, Agent, or Firm* — Altis Law Group, Inc.

(57) ABSTRACT

A radiation resistant clothing includes a first radiation resistant layer for directly reflecting electromagnetic radiation (EMR) and a second radiation resistant layer for absorbing EMR which penetrates through or under the edges of clothing worn over the human body. The second radiation resistant layer is positioned on an inside of the first radiation resistant layer and has radiation absorbing material which dissipates indirect EMR in the form of heat or other energy.

14 Claims, 4 Drawing Sheets

RADIATION RESISTANT CLOTHING

BACKGROUND

1. Technical Field

The present disclosure relates to a protective clothing, and more particularly, to a radiation resistant clothing for resisting electromagnetic radiation (EMR).

2. Description of Related Art

Protective clothing, such as radiation resistant clothing, is necessary for pregnant women, children, hospital patients, and some workers exposed to hazardous EMR. Radiation resistant clothing usually has metal fibers for reflecting EMR away from a body of a person. However, some radiation can still reach the body via sleeves and neckline, etc., and when the radiation reaches into a space between the body and the clothing, it will be reflected to the body by the metal fibers of the clothing, such that the body may still absorb significant radiation.

What is needed is to provide a radiation resistant clothing that can overcome the above-described limitations.

BRIEF DESCRIPTION OF THE DRAWINGS

The components in the drawings are not necessarily drawn to scale, the emphasis instead placed upon clearly illustrating the principles of at least one embodiment. In the drawings, like reference numerals designate corresponding parts throughout the various views, and all the views are schematic.

DETAILED DESCRIPTION

Reference will be made to the drawings to describe certain exemplary embodiments of the present disclosure.

Figure 1:
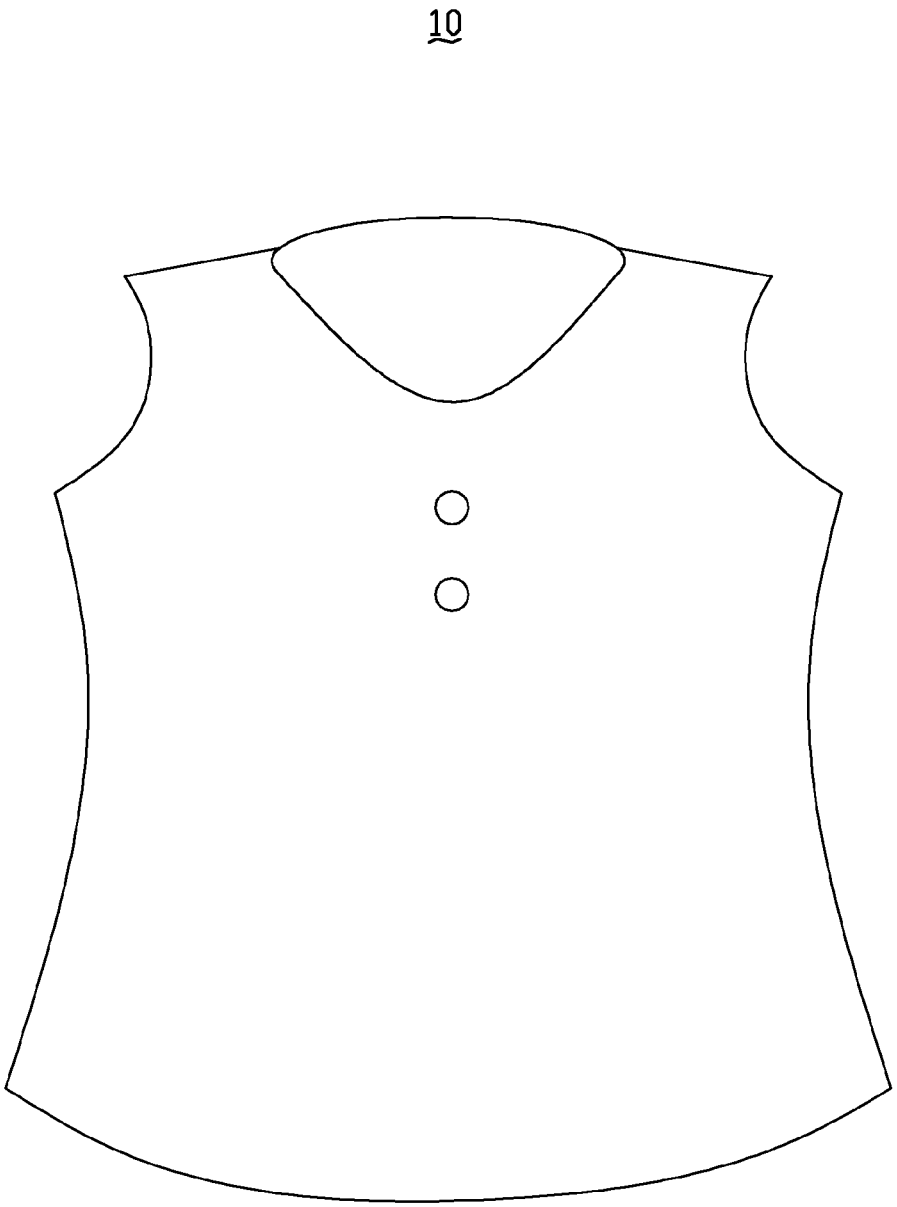
FIG. 1 is a view of an article of radiation resistant clothing of a first embodiment of the present disclosure.
Figure 2:
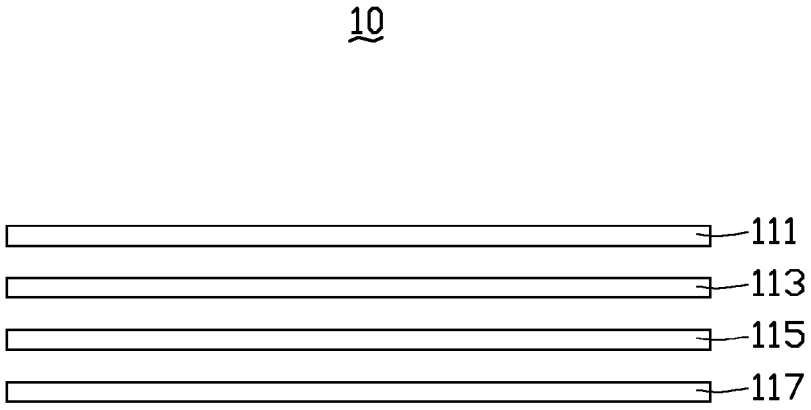
FIG. 2 is a side view of material of the radiation resistant clothing of FIG. 1.

Referring to FIG. 1 and FIG. 2, an article of radiation resistant clothing 10 is shown. The radiation resistant clothing 10 includes an outer cloth layer 111, a first radiation resistant layer 113 for reflecting radiation, a second radiation resistant layer 115 for absorbing radiation, and an inner cloth layer 117. The first radiation resistant layer 113 and the second radiation resistant layer 115 are sandwiched between the outer cloth layer 111 and the inner cloth layer 117. The second radiation resistant layer 115 is positioned on the inside of the first radiation resistant layer 113 and next to the inner cloth layer 117.

The first radiation resistant layer 113 includes EMR shielding material for reflecting EMR. In detail, the EMR shielding material can reflect most EMR. In one embodiment, the first radiation resistant layer 113 includes mixed material made of the radiation shielding material and common clothing fiber material. The EMR shielding material may include material selected from the group consisting of metal fiber material and nanometer metal fiber material. The metal fiber material may be stainless steel fiber material or silver fiber material, and the nanometer metal fiber material may be nanometer silver fiber material.

The second radiation resistant layer 115 includes EMR absorbing material for absorbing EMR as opposed to reflecting EMR. In detail, the EMR absorbing material converts most EMR into heat or other energy. In one embodiment, the second radiation resistant layer 115 includes mixed material made of the radiation absorbing material and the common clothing fiber material. The EMR absorbing material can be silicon carbide fiber material (such as nanometer silicon carbide fiber material) or multi-ion fabric material (such as multi-ion acrylic fiber material), and the common clothing fiber material can include material selected from the group consisting of bamboo rayon fiber material, bamboo carbon fiber material, cotton fiber material, polyester fiber material, and polyamide fiber material.

Both of the outer cloth layer 111 and the inner cloth layer 117 are made of the common clothing fiber material. The common clothing fiber material includes material selected from the group consisting of bamboo rayon fiber material, bamboo carbon fiber material, cotton fiber material, polyester fiber material, and polyamide fiber material.

The radiation resistant clothing 10 includes the a first radiation resistant layer 113 and the second radiation resistant layer 115 positioned on the inside of the first radiation resistant layer 113, thus even EMR which penetrates under the clothing through crevices and open gaps, such as via the ends of sleeves and the neckline, is absorbed by the second radiation resistant layer 115 to avoid the greatest possible protection for the body. Accordingly, the protection effect of the radiation resistant clothing 10 is greatly improved.

Figure 3:
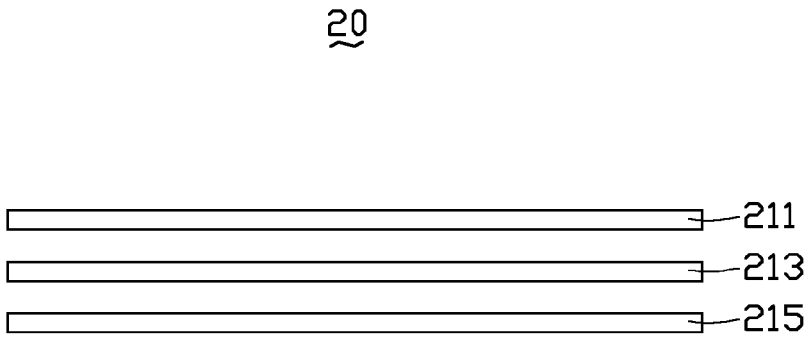
FIG. 3 is a side view of material of the radiation resistant clothing of a second embodiment of the present disclosure.

Referring to FIG. 3, a side view of material of the radiation resistant clothing 20 of a second embodiment of the present disclosure is shown. The radiation resistant clothing 20 differs from the radiation resistant clothing 10 only in that the inner cloth layer 117 is omitted, but an outer layer 211, a first radiation resistant layer 213 and a second radiation resistant layer 215 are respectively the same as the outer layer 111, the first radiation resistant layer 113 and the second radiation resistant layer 115. The second radiation resistant layer 215 includes mixed materials made of radiation absorbing material and common clothing fiber material and serves as an inner layer of the radiation resistant clothing 20.

Figure 4:
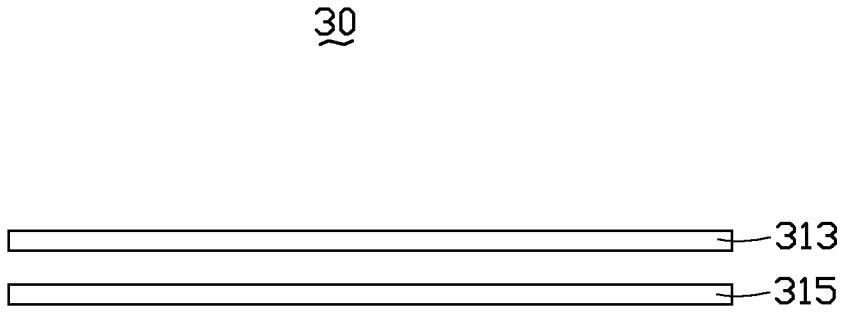
FIG. 4 is a side view of material of the radiation resistant clothing of a third embodiment of the present disclosure.

Referring to FIG. 4, a side view of material of the radiation resistant clothing of a third embodiment of the present disclosure is shown. The radiation resistant clothing 30 differs from the radiation resistant clothing 20 only in that the outer layer 111 and the inner cloth layer 117 are omitted, but a first radiation resistant layer 313 and a second radiation resistant layer 315 are respectively the same as the first radiation resistant layer 213 and the second radiation resistant layer 215. The first radiation resistant layer 313 includes mixed materials made of radiation resistant material and common clothing fiber material and serves as an outer layer of the radiation resistant clothing.

It is to be further understood that even though numerous characteristics and advantages of preferred and exemplary embodiments have been set out in the foregoing description, together with details of the structures and functions of the embodiments, the disclosure is illustrative only; and changes may be made in detail, especially in the matters of shape, size and arrangement of parts within the principles of the present disclosure to the full extent indicated by the broad general meaning of the terms in which the appended claims are expressed.

What is claimed is:

1. Radiation resistant clothing, comprising:

a first radiation resistant layer for reflecting electromagnetic radiation (EMR); and a second radiation resistant layer comprising radiation absorbing material for absorbing EMR, the second radiation resistant layer positioned on an inside of the first radiation resistant layer.

2. The radiation resistant clothing of claim 1, wherein the radiation absorbing material comprises silicon carbide fiber material.

3. The radiation resistant clothing of claim 1, wherein the radiation absorbing material comprises multi-ion fabric material.

4. The radiation resistant clothing of claim 3, wherein the multi-ion fabric material is multi-ion acrylic fiber material.

5. The radiation resistant clothing of claim 1, wherein the first radiation resistant layer comprises metal fiber material.

6. The radiation resistant clothing of claim 5, wherein the metal fiber material is material selected from the group consisting of steel fiber material and silver fiber material.

7. The radiation resistant clothing of claim 5, wherein the first radiation resistant layer comprises nanometer metal fiber material.

8. The radiation resistant clothing of claim 7, wherein the nanometer metal fiber material is nanometer sliver fiber material.

9. The radiation resistant clothing of claim 1, further comprising an outer cloth layer positioned on an outside of the first radiation resistant layer away from the second radiation resistant layer.

10. The radiation resistant clothing of claim 1, further comprising an inner cloth layer positioned on an inside of the second radiation resistant layer away from the first radiation resistant layer.

11. The radiation resistant clothing of claim 1, wherein the second radiation resistant layer comprises mixed material made of the radiation absorbing material and common clothing fiber material, and the common clothing fiber material comprises material selected from the group consisting of bamboo rayon fiber material, bamboo carbon fiber material, cotton fiber material, polyester fiber material, and polyamide fiber material.

12. The radiation resistant clothing of claim 11, wherein the radiation absorbing material comprises silicon carbide fiber material.

13. The radiation resistant clothing of claim 1, wherein the first radiation resistant layer comprises mixed material made of radiation shielding material and common clothing fiber material, and the common clothing fiber material comprises material selected from the group consisting of bamboo rayon fiber material, bamboo carbon fiber material, cotton fiber material, polyester fiber material, and polyamide fiber material.

14. The radiation resistant clothing of claim 13, wherein the radiation shielding material comprises material selected from the group consisting of metal fiber material and nanometer metal fiber material.

* * * * *